US005992177A

United States Patent [19]

Beard

[11] Patent Number: 5,992,177

[45] Date of Patent: Nov. 30, 1999

[54] GEM STONE MOUNT

[76] Inventor: Guy Beard, 2763 Southwood La., Jacksonville, Fla. 32207

[21] Appl. No.: 09/032,146

[22] Filed: Feb. 27, 1998

[51] Int. Cl.[6] ..... A44C 17/02

[52] U.S. Cl. ..... 63/29.1; 63/26

[58] Field of Search ..... 63/26, 29.1, 30, 63/15; 29/10

[56] References Cited

U.S. PATENT DOCUMENTS

| | | | |
|---|---|---|---|
| 949,657 | 2/1910 | Murrin | 63/26 |
| 1,383,146 | 6/1921 | Perrin | 63/29.1 |
| 1,400,460 | 12/1921 | Rosenthal | 63/29.1 |
| 1,457,196 | 5/1923 | Stein | 63/29.1 |
| 1,529,606 | 3/1925 | O'Donnell | 63/26 |
| 1,568,924 | 1/1926 | Shatkin | 63/29.1 |
| 3,605,442 | 9/1971 | Parker et al. | 63/26 X |
| 3,905,525 | 9/1975 | Kawamata | 63/29.1 X |
| 5,375,434 | 12/1994 | Wertheimer et al. | 63/29.1 |

FOREIGN PATENT DOCUMENTS 233991 9/1987 European Pat. Off. .

*Primary Examiner*—Terry Lee Melius
*Assistant Examiner*—William L. Miller
*Attorney, Agent, or Firm*—Thomas C. Saitta

[57] ABSTRACT

A gem stone mounting which is able to receive any of a number of different cut gem stones, the mounting having a base member with a bore to provide an open area for the back of the stone, a sloped forward wall having an annular receiving channel, in which is seated an annular sizing member circular in cross-section and formed of a resilient and compressible material, and threading which mates with the threading of an engagement cap member having a large central opening to expose the face of the stone, where the sizing member adapts to the particular gemstone and prevents contact between the back of the gem stone and the base member.

13 Claims, 1 Drawing Sheet

GEM STONE MOUNT

BACKGROUND OF THE INVENTION

This invention relates generally to settings or mounts used to retain a gem stone in a piece of jewelry such as a ring, pendant, earring, etc., as well as the articles of jewelry themselves. More particularly, the invention relates to a mount for securing the gem stone in the jewelry piece which comprises a pair of mating members which join by threaded engagement means to retain the gem stone, such that deformation of the metal comprising the mount is not required to secure the gem stone therein.

Diamonds, emeralds, rubies and other precious gem stones are cut and mounted into jewelry for the adornment of the wearer. The jewelry piece may be a ring, a pendant on a necklace, a brooch, earrings, etc. and the mounts are usually composed of a precious metal such as gold or silver. The gem stones are cut to enhance light reflection and refraction, and it is therefore desirable to mount a gem stone in a mounting or setting which does not interfere with the visual brilliance of the gem stone. This desire to minimize the amount of material securing the gem stone must be offset by the need to adequately secure the valuable gem stone within the mounting. In addition, since gem stones are hand cut each will vary in configuration. A typical mounting method is to provide a mount with a seating ring adapted to retain a portion of the rear of the gem stone and to provide a small number of fingers or prongs which are bent onto the top of the gem stone to lock the gem stone between the prongs and the ring. Another similar method is to provide an annular rim which is deformed around the top of the gem stone to interlock the gem stone between the outer ring and the seating ring. Both of these methods have been used for many years and are most adequate in securing the gem stone in the jewelry piece, as they allow the craftsman to deform the mount to fit the particular gem stone. The major drawback to these types of mounts in the commercial world is that, to insure that the setting is secure and to produce an aesthetically pleasing piece of jewelry, the work of deforming the metal around the gem stone must be performed by a skilled craftsman properly trained and experienced in the art of mounting gem stones. This fact means that retailers without such a skilled employee cannot offer gem stone mounting on the premises, resulting in increased costs, risk of loss, and delay problems to the consumer.

It is an object of this invention to provide an aesthetically pleasing gem stone mount which securely retains the gem stone in the setting without unduly interfering with the visual brilliance of the gem stone, where the gem stone can be secured within the mount in a relatively simple manner by untrained and unskilled individuals, such that creation of the jewelry piece is relatively easy, and further such that gem stones may be easily interchanged within a single mount, such as for example exchanging a diamond for a ruby to alter the color of the jewelry. It is a further object to provide such a mount which is generally universal in its acceptance of gem stones, within certain ranges, and which can be mass produced without the need to precisely match each mount to a particular gem stone. In order to accomplish this, the variation in individual gem stones must be taken into account. This variation includes not only the overall size of the gem stone but also the particular cut of the gem stone, i.e., the number of facets, the angles between the facets, the relative size ratios of individual facets to each other, the height and width of the gem stone, etc. While a skilled craftsman can bend and form the malleable metal of a typical mount to account for these variations, thereby creating a mount which corresponds exactly as required to the particular gem stone being secured therein, a more universal mount must be able to accommodate and account for individual gem stone size and shape differences within a reasonable range. To this end, the invention utilizes a pair of interlocking members which secure the gem stone therebetween, the members being preferably joined by threaded engaging means and preferably having an annular, resilient, sizing member which abuts a small portion of the back of the gem stone.

Other dissimilar attempts to provide a universal gem stone mount or a means to allow for relatively simple removal and replacement of gem stones within a mount or setting include mounts wherein a gem stone is mounted in a retaining member which is removable from the jewelry piece, such as shown in U.S. Pat. No. 1,383,146 to Perrin. In Perrin, the gem stone is mounted within a threaded, removable, retaining member in the conventional fashion by forming the metal about the gem stone, meaning that a skilled craftsman must be utilized and a separate retaining member provided for each gem stone. In U.S. Pat. No. 949,657 to Murrin, a permanent setting is created by providing a threaded, annular collar which abuts the back of the gem stone, the front of the gem stone being retained by an annular lip formed in the main body of the jewelry piece. The internal collar must be provided with spanner recesses to allow it to be threaded into the main body. Because the edges and facets of the gem stone directly contact the metal of the setting, the security of this setting will deteriorate over time and the stone is likely to loosen. In addition, excessive stresses at the metal to gem stone contact interface which may be created during the threading process can cause the gem stone to crack or chip. U.S. Pat. No. 3,605,442 to Parker et al. shows the use of an annular, plastic cushion to back the gem stone to provide shock resistance and seal the back side of the stone in a permanent setting, but the cushion is used with a standard setting where the stone is retained by deforming the upper lip or rim of the main body of the setting. In addition, the annular cushion is to be triangular in cross-section and is provided with a tapered surface of particular angle (less than 50 degrees) which is to correspond to a seat bevel cut into the stone. Correct sizing of the setting is accomplished by providing a separate shim member of the desired dimensions composed of a relatively non-compressible plastic. A setting with a removable gem stone is shown in U.S. Pat. No. 5,375,434 to Wertheimer et al., wherein a complicated, multiple hinged cover is taught—the cover encircling the main body of the jewelry piece and mechanically locking in order to secure the stone.

SUMMARY OF THE INVENTION

The invention is a gem stone mount or setting which securely receives and retains a gem stone in a manner which allows for the relatively simple creation of the finished piece of jewelry and further allows for easy exchange of one gem stone for another, both purposes being accomplished without the need of skilled, trained or experienced craftsmen and where no metal deformation is required. The gem stone mount comprises in general a main body base member, which can comprise the means to attach the jeweler piece to a person or an article such as clothing, a necklace strand, a bracelet strand or the like, an annular engagement cap which mechanically interlocks with the main body such that a gem stone is securely disposed therebetween, and a circular in cross-section, resilient, compressible, sizing member positioned within a semi-circular in cross-section receiving channel within the main body, where the back of the gem stone abuts the sizing member only such that no metal to stone contact occurs on the rear of the gem stone and further such that the sizing member deforms to account for variations within a given range for the particular size and configuration of the gem stone being mounted therein. The engagement cap member is preferably threadingly joined to the main body member, such that a single mount can accommodate variations in height between individual gem stones, since the overall length of the combined engagement cap and base member is adjustable, while still providing secure retention of the stone in combination with the sizing member.

DETAILED DESCRIPTION OF THE INVENTION

Figure 2:
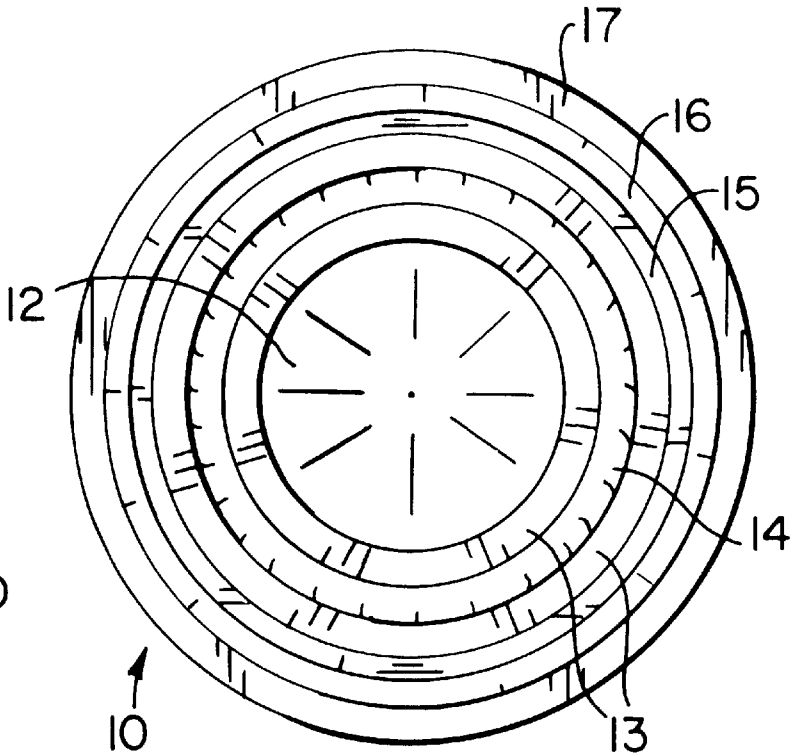
FIG. 2 is a front view of the main body base member.

With reference to the drawings, the invention will now be described in detail with regard for the best mode and the preferred embodiment. In general, the invention comprises three main components, a main body base member 10, a sizing member 20, and an engagement cap member 30, which in combination secure therebetween a gem stone 40. The gem stone 40 consists of a precious stone or an artificial stone (e.g., cubic zirconia) shaped and cut into a desired configuration, typically with a number of facets. The gem stone 40 will have a generally flat front face 41, a sloped front side 42, a sloped back side 43 usually terminating in a point 44, and a shoulder 45 situated at the junction of the sloped front side 42 and the sloped back side 43, the diameter or width of stone at the shoulder 45 being greater than at the face 41. Such configurations are very typical for cut diamonds, rubies, sapphires and other precious stones.

Figure 1:
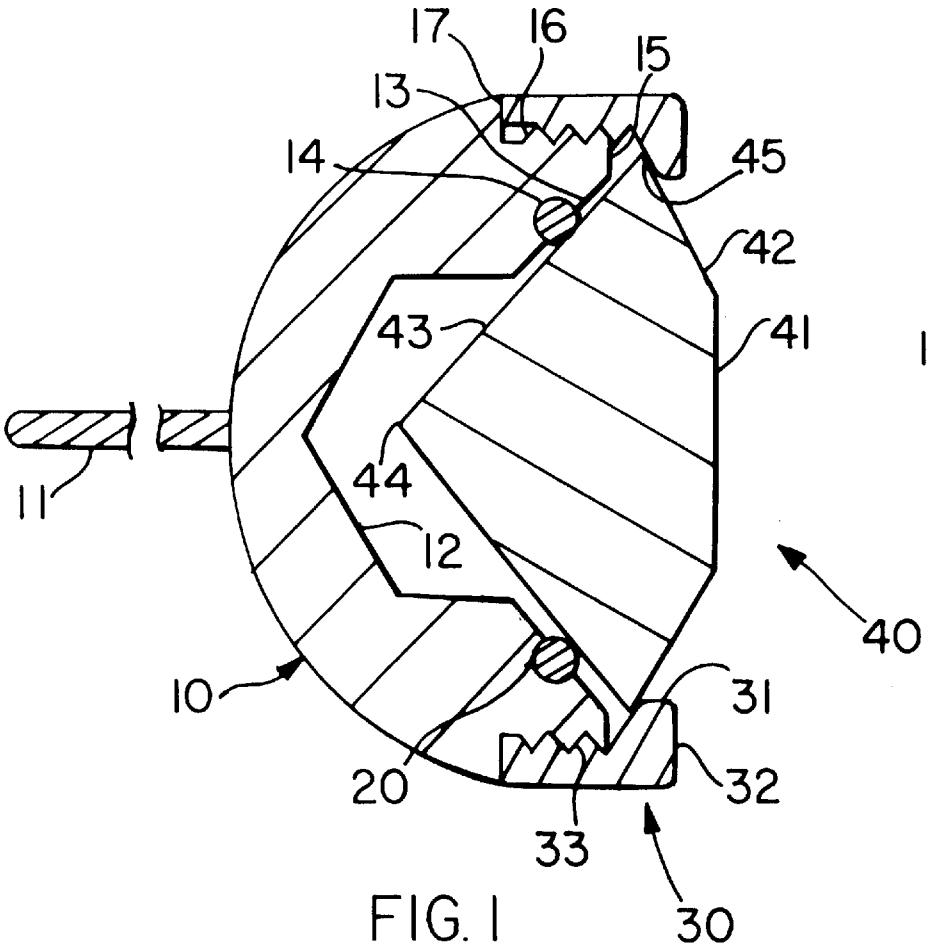
FIG. 1 is a cross-sectional side view of the invention showing a gem stone secured between the main body base member and the engagement cap, the stone seated on the resilient sizing member.

The base member 10 and the engagement cap member 30 are formed of a metal, preferably a precious metal such as gold or silver, but any metal of suitable hardness may be used, since the metal does not need to be of sufficient malleability to be deformed around the gem stone 40 for securing the stone 40 in the jewelry piece. The base member 10 preferably comprises the means to attach the piece to the wearer, and the means of attachment 11 may include eyelets, loops, posts, catches, clasps, pins, etc., all of which are well known in the industry for the attachment of a jewelry piece to clothing, necklaces, bracelets, fingers, earlobes, etc. Thus the base member 10 may be an earring, a ring, a pendant, etc. In FIG. 1, attachment means 11 is shown as a post which is designed to be inserted through a hole pierced in an ear lobe. Alternatively, the engagement cap member 30 may comprise the means for attachment 11, such as for example a loop through which a chain can be threaded.

The base member 10 comprises a bore 12 which may or may not pass completely therethrough. The bore 12 provides space to receive the point 44 and back side 43 of the gem stone 40 without contacting the back side 43, and is preferably circular in cross-section. The forward or outer wall 13 of the base member 10 is completely or partially bevelled or tapered inward toward bore 12 and forms an sloped annular member which corresponds generally to the sloped back side 43 of the gem stone 40, but does not need to match the slope exactly. Coaxially positioned within the sloped forward wall 13 is an annular receiving channel 14, preferably semi-circular in cross-section, as shown in FIG. 2. The external portion of the outer rim 15 of the base member 10 is provided with helical threading 16, preferably recessed to create a shoulder 17 so that the exterior of the engagement cap 30 will be flush when connected.

A sizing member 20 circular in cross-section and formed of a compressible, resilient material such as a rubber or polymer is seated within the annular receiving channel 14 of base member 10. Such a sizing member 20 is commonly referred to as an O-ring. Preferably at least half of the sizing member 20 extends from the receiving channel 14, and is of sufficient density such that the sizing member 20 prevents contact between the back side 43 of the gem stone 40 and the sloped forward wall 13 of the base member 10 when the stone 40 is compressed between the base member 10 and the engagement cap member 30. The sizing member 20 must also have some relatively slight degree of compressibility, such that variations in the angles and facets on the back side 43 of the stone 40 are accommodated and a secure seating is obtained. This factor enables a single base member 10 to receive any of a large number of stones 40 which fall within general size parameters, without the need to customize the base member 10 or the engagement cap member 30 for any particular stone 40. The sizing member 20, in addition to adapting to the particular gem stone 40 to provide a stable seating, also acts as a seal to prevent dust, debris, liquid, etc. from passing behind the stone 40 and into the base member 10. The sizing member 20 minimizes the area of contact on the back side 43 of the gem stone 40, since the sizing member 20 will only contact the gem stone 40 along a very narrow circular line or band, thus providing minimal interference to light reflection, refraction and passage.

The engagement cap member 30 comprises a large central opening 31 for exposure of the face 41 and most of the front side 42 of the gem stone 40, and the opening 31 is surrounded by an annular flange member 32. The flange 32 is preferably sloped on its inward side and abuts the sloped front side 42 of the gem stone 40. The cap member 30 is internally threaded with helical threads 33 which correspond to the threads 16 of the base member 10. In this manner the engagement cap member 30 can be attached to the base member 10 to secure the gem stone 40. Because the shoulder 45 of the gem stone 40 is of greater diameter than the cap opening 31, the gem stone 40 cannot pass through the opening 31. As the cap member 30 is rotated onto the base member 10, the gem stone 40 is pressed against the sizing member 20 and metal to stone contact is prevented on the back side 42 of the gem stone 40. Since the overall length in the axial direction between the cap member 30 and the base member 10 is determined by the extent of rotation, i.e., the more the rotation the shorter the overall length of two members, variations in the front to back thickness of a gem stone 40 can be accommodated without needing to customize the setting.

Although shown with external threads 16 on the base member 10 and internal threads 33 on the cap member 30, the mounting could also be constructed in reverse with internal threading 16 on the base member 10 and external threading 33 on the cap member 30.

It is understood that certain equivalents and substitutions may be obvious to those skilled in the art to certain components and elements set forth above, and the true scope and definition of the invention therefore is to be as set forth in the following claims.

I claim:

1. A jewelry mount device for a cut gem stone, comprising:

(A) a base member having a bore to receive a back side of the gem stone, a sloping annular forward wall containing an annular receiving channel, and threading to receive an engagement cap member;

(B) an annular sizing member, circular in cross-section, formed of a resilient and compressible material, and seated within said annular receiving channel; and (C) said engagement cap member joined to said base member and comprising an opening surrounded by an annular flange member and threading corresponding to said threading of said base member, whereby said cap member can be rotatingly engaged with said base member for enclosing the gem stone therebetween, where the overall length of the combined said base member and said engagement cap member is adjustable.

2. The device of claim 1, where said base member threading is externally positioned and said engagement cap member threading is internally positioned.

3. The device of claim 1, further comprising attachment means for attaching the mount to an object.

4. The device of claim 1, where said annular receiving channel is semi-circular in cross-section.

5. The device of claim 1, where at least half of said sizing member extends from said annular receiving channel.

6. The device of claim 1, where said sizing member prevents contact between said front wall of said base member and the backside of the gem stone enclosed between said base member and said cap member.

7. A piece of jewelry device comprising:

(A) a cut gem stone having a face, a shoulder and sloped back side;

(B) a base member having a bore to receive said back side of said gem stone, a sloping annular forward wall containing an annular receiving channel, and threading to receive an engagement cap member;

(C) an annular sizing member, circular in cross-section, formed of a resilient and compressible material, and seated within said annular receiving channel; and (D) said engagement cap member joined to said base member and comprising an opening surrounded by an annular flange member and threading corresponding to said threading of said base member, whereby said cap member can be rotatingly engaged with said base member enclosing said gem stone therebetween where said face of said gem stone is visible through said engagement cap opening and where said back side of said gem stone contacts said sizing member and does not contact said bore or said forward wall of said base member.

8. The device of claim 7, where said gem stone shoulder has a diameter greater than the diameter of said engagement cap opening.

9. The device of claim 7, where the overall length of the combination of said base member and said engagement cap member when engaged is variable.

10. The device of claim 7, where said base member threading is externally positioned and said engagement cap member threading is internally positioned.

11. The device of claim 7, further comprising attachment means for attaching the mount to an object.

12. The device of claim 7, where said annular receiving channel is semi-circular in cross-section.

13. The device of claim 7, where at least half of said sizing member extends from said annular receiving channel.

* * * * *